US007595757B2

(12) United States Patent
Sotoudeh et al.

(10) Patent No.: US 7,595,757 B2
(45) Date of Patent: Sep. 29, 2009

(54) ELECTRICAL CONNECTION ELEMENTS PROVIDED IN THE AMC STRUCTURE OF AN ANTENNA ARRANGEMENT

(75) Inventors: Omid Sotoudeh, Upplands Väsby (SE); Soren Karlsson, Upplands Väsby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 240 days.

(21) Appl. No.: 11/739,286

(22) Filed: Apr. 24, 2007

(65) Prior Publication Data

US 2008/0266179 A1 Oct. 30, 2008

(51) Int. Cl.
*H01Q 1/38* (2006.01)

(52) U.S. Cl. ..... 343/700 MS; 343/909

(58) Field of Classification Search ..... 343/700 MS, 343/909, 702

See application file for complete search history.

(56) References Cited

U.S. PATENT DOCUMENTS

| | | | | |
|---|---|---|---|---|
| 6,232,931 | B1 | 5/2001 | Hart | |
| 6,690,327 | B2 * | 2/2004 | McKinzie et al. | 343/700 MS |
| 6,768,476 | B2 * | 7/2004 | Lilly et al. | 343/909 |
| 7,411,565 | B2 * | 8/2008 | McKinzie et al. | 343/909 |
| 7,420,524 | B2 * | 9/2008 | Werner et al. | 343/909 |
| 2004/0160370 | A1 | 8/2004 | Ghosh et al. | |
| 2006/0092079 | A1 | 5/2006 | de Rochemont | |

FOREIGN PATENT DOCUMENTS

| | | | |
|---|---|---|---|
| WO | WO 02/11239 | A2 | 2/2002 |
| WO | WO 02/41447 | A1 | 5/2002 |
| WO | WO 02/089256 | A1 | 11/2002 |
| WO | WO 2004/093244 | A2 | 10/2004 |

OTHER PUBLICATIONS

Daniel Sievenpiper et al., "High-Impedance Electromagnetic Surfaces with a Forbidden Frequency Band", in IEEE Transactions on Microwave Theory and Techniques, vol. 47, No. 11, Nov. 1999, pp. 2059-2074.

Alexandros P. Feresidis et al. "Artificial Magnetic Conductor Surfaces and Their Application to Low-Profile High-Gain Planar Antennas", in IEEE Transactions on Antennas and Propagation, vol. 53, No. 1, Jan. 2005, pp. 209-215.

George Gousettis et al., "Tailoring the AMC and EBG Characteristics of Periodic Metallic Arrays Printed on Grounded Dielectric Substrate", in IEEE Transactions on Antennas and Propagation, vol. 54, No. 1, Jan. 2006, pp. 82-89.

Romulo F. Jimenez Broas et al. "A High-Impedance Ground Plane Applied to a Cellphone Handset Geometry", in IEEE Transactions on Microwave Theory and Techniques, vol. 49, No. 7, Jul. 2001, pp. 1262-1265.

International Search Report and Written Opinion dated Mar. 5, 2008, issued in corresponding PCT application No. PCT/EP2007/061341, 12 pages.

* cited by examiner

*Primary Examiner*—Tan Ho
(74) *Attorney, Agent, or Firm*—Harrity & Harrity LLP

(57) ABSTRACT

A portable communication device comprises an antenna arrangement having a radiating antenna element and a grounding layer comprising an AMC material structure facing the radiating antenna element. The AMC material structure includes at least one layer of patches connected to a smooth conducting layer using conducting vias and electrical connection elements that selectively interconnect patches in a layer with other elements of the AMC structure. In this way a low profile antenna arrangement is provided that allows the coverage of a broad frequency band and/or directivity.

23 Claims, 3 Drawing Sheets

ELECTRICAL CONNECTION ELEMENTS PROVIDED IN THE AMC STRUCTURE OF AN ANTENNA ARRANGEMENT

TECHNICAL FIELD OF THE INVENTION

The present invention relates to antennas and, more particularly, to an antenna arrangement for portable communication devices, as well as a portable communication device including an antenna arrangement.

DESCRIPTION OF RELATED ART

There is a trend within the field of portable communicating devices, and especially within the field of cellular phones to have the main communication antenna built-in in the phone. Such phones are also becoming increasing compact, with a need for optimal use of space available in the phone. Accordingly, a need exists to make antennas smaller and reduce the antenna volume as much as possible. However, when this is done, the performance of the antenna is typically degraded.

Recently, research has been conducted in the field of artificial magnetic conductor (AMC) materials for use in antennas. An AMC material is a metallic electromagnetic structure that has a high surface impedance. It is implemented through the use of two- or three-dimensional lattice structures of metal or dielectric objects. Such objects may be formed as plates connected to a solid ground layer using conducting vias. The AMC structure does not support propagating surface waves for certain frequency bands. This type of structure is, for instance, described by Sievenpiper et al. in "High-Impedance Electromagnetic Surfaces with a Forbidden Frequency Band," in IEEE Transactions on Microwave Theory and Techniques, Vol. 47, No. 11, November 1999.

These types of surfaces are referred to as electromagnetic band gap (EBG) surfaces and photonic band gap (PBG) surfaces.

The evolution of such surfaces allows a considerable reduction of the profile of an antenna. Investigations in this regard have, for instance, been made by Alexandros P. Feresidis et al. in "Artificial Magnetic Conductor Surfaces and Their Application to Low-Profile High-Gain Planar Antennas," in IEEE Transactions on Antennas and Propagation, Vol. 53, No. 1, January 2005.

How to design a material with regard to a frequency band is described by George Gousettis et al. in "Tailoring the AMC and EBG Characteristics of Periodic Metallic Arrays Printed on Grounded Dielectric Substrate," in IEEE Transactions on Antennas and Propagation, Vol. 54, No. 1, January 2006.

However, most of the literature is directed to large antennas, in terms of wavelengths, for example, scaled for use in cellular base stations, and not for use in portable communication devices and cellular phones in which small terminal antennas are utilized and the performance challenges associated with these types of devices.

The use of such a material in a cordless phone has been described by Romulo F. Jimenez Broas et al. in "A High-impedance Ground Plane Applied to a Cellphone Handset Geometry," in IEEE Transactions on Microwave Theory and Techniques, Vol. 49, No. 7, July 2001. In a handset described therein, a part of the ordinary circuit board is provided with an AMC structure, and the document thus suggests placing an antenna side-by-side with other components of such a cordless handset. This type of implementation of these surfaces does not, however, resolve the issues with high current distributions on the printed circuit board itself.

Accordingly, a need exists for advantageous uses of an AMC material relative to a portable communication device to, among other things, reduce the size, provide superior broadband properties, as well as for influencing the directivity.

SUMMARY OF THE INVENTION

Implementations of the present invention are generally directed to providing an improved AMC material relative to a portable communication device and antennas in such a portable communication device.

According to a first aspect of the present invention, an antenna arrangement is arranged for provision in a portable communication device and including:

a radiating antenna element, and a grounding layer comprising an AMC material structure facing the radiating antenna element, which AMC material structure includes at least one layer of patches and a smooth conducting layer, the AMC material structure further including electrical connection elements that selectively interconnect patches in a layer with other elements of the AMC structure.

A second aspect of the present invention is directed to an antenna arrangement including the features of the first aspect, in which at least some of the patches in the layer are connected to the smooth conducting layer using conducting vias.

A third aspect of the present invention is directed to an antenna arrangement including the features of the second aspect, including at least one further layer of patches.

A fourth aspect of the present invention is directed to an antenna arrangement including the features of the third aspect, in which patches in at least one further layer are floating electrically.

A fifth aspect of the present invention is directed to an antenna arrangement including the features of the second aspect, in which elements for at least one layer of patches are provided in vias between the patches of a layer and the smooth conducting layer.

A sixth aspect of the present invention is directed towards an antenna arrangement including the features of the first aspect, in which elements for at least one layer of patches are provided in the layer and selectively interconnect patches in this layer.

A seventh aspect of the present invention is directed towards an antenna arrangement including the features of the first aspect, in which the elements are passive elements in the form of filters that connect the patches with other elements based on frequency.

An eighth aspect of the present invention is directed towards an antenna arrangement including the features of the first aspect, in which the elements are active elements in the form of switches.

A ninth aspect of the present invention is directed towards an antenna arrangement including the features of the eighth aspect in which the switches can be operated from fully closed to fully open positions and occupy partially open positions in-between.

A tenth aspect of the present invention is directed towards an antenna arrangement including the features of the eighth aspect, in which the switches can be controlled through application of electrical signals.

An eleventh aspect of the present invention is directed towards an antenna arrangement including the features of the eighth aspect in which the switches can be controlled through application of optical signals.

According to a twelfth aspect of the present invention, a portable communication device is provided comprising: a radiating antenna element, and a grounding layer comprising an AMC material structure facing the radiating antenna element, which AMC material structure includes at least one layer of patches and a smooth conducting layer, the AMC material structure further comprising electrical connection elements that selectively interconnect patches in a layer with other elements of the AMC structure.

A thirteenth aspect of the present invention is directed towards a portable communication device including the features of the twelfth aspect, in which at least some of the patches in the layer are connected to the smooth conducting layer using conducting vias.

A fourteenth aspect of the present invention is directed towards a portable communication device including the features of the thirteenth aspect, further comprising at least one further layer of patches.

A fifteenth aspect of the present invention is directed towards a portable communication device including the features of the fourteenth aspect, in which patches in at least one further layer are floating electrically.

A sixteenth aspect of the present invention is directed towards a portable communication device including the features of the thirteenth aspect, in which elements for at least one layer of patches are provided in vias between the patches of the layer and the smooth conducting layer.

A seventeenth aspect of the present invention is directed towards a portable communication device including the features of the twelfth aspect, in which elements for at least one layer of patches are provided in the layer and selectively interconnect patches in this layer.

An eighteenth aspect of the present invention is directed towards a portable communication device including the features of the twelfth aspect, in which the elements are passive elements in the form of filters that connect the patches with other elements based on frequency.

A nineteenth aspect of the present invention is directed towards a portable communication device including the features of the twelfth aspect, in which the elements are active elements in the form of switches.

A twentieth aspect of the present invention is directed towards a portable communication device including the features of the nineteenth aspect, in which the switches can be operated from fully closed to fully open positions and occupy partially open positions in-between.

A twenty-first aspect of the present invention is directed towards a portable communication device including the features of the nineteenth aspect, in which the switches can be controlled through application of electrical signals.

A twenty-second aspect of the present invention is directed towards a portable communication device including the features of the nineteenth aspect, in which the switches can be controlled through application of optical signals.

A twenty-third aspect of the present invention is directed towards a portable communication device including the features of the twelfth aspect, in which it is a cellular phone.

The invention has a number of advantages. The profile of the antenna arrangement can be made very low that allows the provision of slimmer portable communication devices. The invention furthermore allows the coverage of a broader frequency band and/or provision of directivity and thus the power of the portable communication device is used in a more efficient way.

It should be emphasized that the terms "comprises/comprising" and/or "includes/including," when used herein, generally denote the presence of stated features, integers, steps or components, but do not preclude the presence or addition of one or more other features, integers, steps, components or groups thereof.

BRIEF DESCRIPTION OF THE DRAWINGS

The present invention will now be described in more detail relative to the enclosed drawings, in which.

DETAILED DESCRIPTION OF EMBODIMENTS

Figure 1:
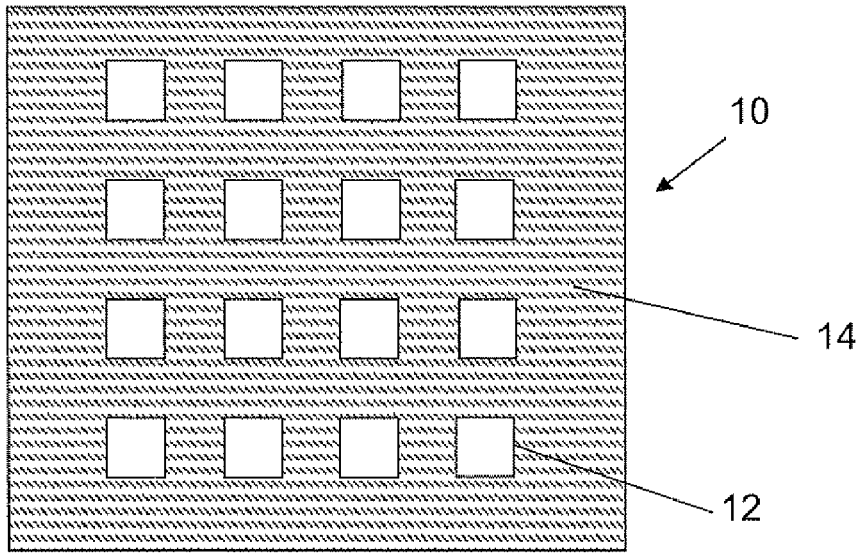
FIG. 1 shows a top view of one exemplary lattice structure for an AMC material in which systems and methods described herein may be implemented.

FIG. 1 schematically shows a top view of an artificial magnetic conductor (AMC) material structure, according to one implementation. An AMC material structure 10 may include a substrate 14 of dielectric material, for example, and a number of patches 12 of electrically conducting material organized in a symmetrical structure that may include a lattice structure. In FIG. 1, each patch 12 is shown as being quadratic. This is just one example of such a patch shape. The patches may have any suitable shape, for instance, in the form of concentric rings or have pentagonal, hexagonal, octagonal, or other regular or irregular shape. It should be appreciated that the lattice structure can be varied in many ways. The patches may have different sizes and shapes between layers or within each layer, for example, to allow wideband or multiband characteristics. Some, all, or none of patches 12 of the layer may connect to an underlying smooth conducting layer using, for example, a vertical conducting via(s).

Figure 2A:
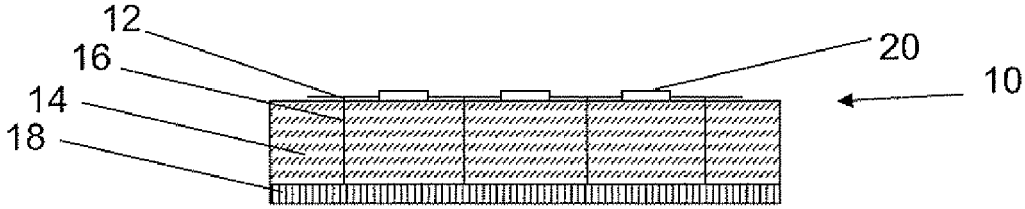
FIGS. 2A and B schematically show side views of the structure of the AMC material for one exemplary structure provided with electrical connection elements according to the principles of the present invention.

FIG. 2A shows AMC material structure 10 that may include a single layer of patches 12, which may be suitable for use relative to antennas operating at a high frequency band. This structure is also shown to more clearly show the relationship between elements of the present invention. Patches 12 may be provided substantially normally on an exposed surface of substrate 14, through which vias 16 may extend from patches 12 to a conducting layer 18 that may be substantially planar. When AMC material structure 10 is used as ground for an antenna, conducting layer 18 may connect to ground. AMC material structure 10 may not support propagating surface waves in the frequency band for which it is designed, since AMC material structure 10 may possess a high surface impedance in the subject band. These types of surfaces may be referred to as electromagnetic band gap (EBG) surfaces or photonic band gap (PGB) surfaces. The system of patches and vias, which together may generate the band gaps for surface waves at the designed frequencies, may also generate an effective capacitance and inductance. This capacitance and inductance may help to reduce the design frequency of the combined system of antenna and AMC surface relative to the antenna and patch sizes. The profile of antennas may be thereby be reduced.

AMC material structure 10 may include a number of electrical connection elements or switches 20. In one embodiment of the present invention, electrical connection elements 20 may be disposed in a same layer in which patches 12 are disposed. At least some of electrical connection elements 20 may selectively interconnect ones of patches 12 to other ones of patches 12, for example, in a same layer. In one embodiment of the present invention, ones of electrical connection elements 20 function as a switch which selectively connects ones of patches 12 to other ones of patches 12. As previously mentioned, some, all, or none of patches 12 of a layer may be connected to conducting layer 18 using vias 16. Ones of patches 12 that are not connected to conducting layer 18 may "float," in an electrical sense. Each of patches 12 in a layer need not be interconnected with ones of electrical connection elements 20.

Figure 2B:
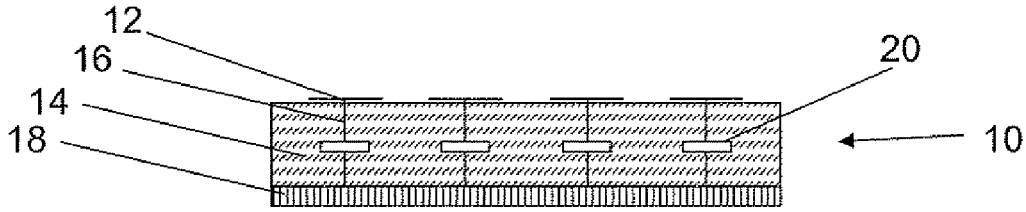

FIG. 2B shows AMC material structure 10 according to another embodiment of the present invention, in which electrical connection elements 20 are not provided between patches 12 in a same layer, but in an area with vias 16 that may connect to patches 12. Ones of electrical connection elements 20 may selectively interconnect ones of patches 12 to conducting layer 18. It should be appreciated that all, some, or none of patches 12 may be associated with ones of electrical connection elements 20 provided in an area of ones of vias 16.

The present technology of mobile phones or handsets has reached a certain standard of dimensions of such devices and they continue to be produced increasingly smaller. For such dimensions, it becomes evident that AMC material structure 10 of FIGS. 2A and 2B is suited for high frequencies, and operatively in the order of several GHz. To enable use of AMC material structure 10 at lower frequencies, for instance, GSM frequencies at around 800 MHz, AMC material structure 10 can be varied.

Figure 3:
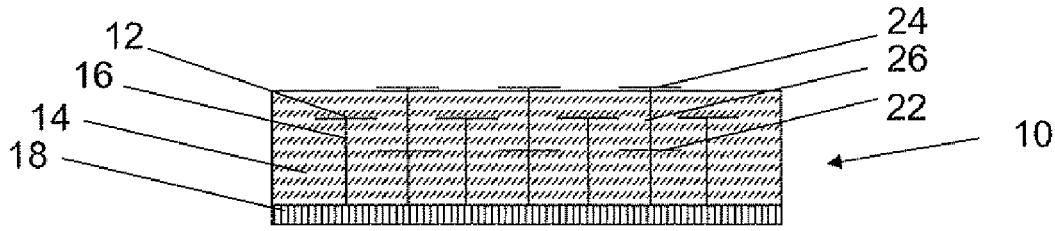
FIG. 3 shows another AMC structure in which electrical connection elements may be provided.

FIG. 3 shows an implementation in which AMC material structure 10 may be varied for obtaining the above-mentioned properties in lower bands. FIG. 3 shows AMC material structure 10 including three layers of patches 12, 22, 24. Patches 12, 22, 24 may be provided vertically arranged relative to each other, the lattice structure of intermediate layers having been shifted relative to each other so that ones of patches 12, 22, 24 of one layer may be provided in gaps between ones of patches 12, 22, 24 of an adjacent layer. It should be appreciated that ones of patches 12, 22, 24 of adjacent layers may overlap each other.

As can be seen in FIG. 3, AMC material structure 10 may include patches 22 in a bottom layer of substrate 14 having a certain lattice structure may connect to conducting layer 18 using vias 26, and an intermediate layer of patches 12 with a substantially same lattice structure but shifted in a horizontal direction. Patches 12 of the intermediate layer may connect to conducting layer 18 using vias 16. AMC material structure 10 may include a top layer of patches 24 with a substantially same lattice structure and having patches 24 that may align with patches 22 of the bottom layer.

In the arrangement described, vias 26 associated with the bottom layer of patches 22 may traverse through substrate 14 from ones of patches 22 to ones of patches 24 of the top layer. Substrate 14 may provided between the top layer of patches 24 and conducting layer 18 and surround the bottom and intermediate layers of patches 22 and 12. Using this arrangement, where it is possible to add N layers of patches (e.g., patches 12, 22, 24) over each other, and varying the sizes and shapes of the patches e.g., patches 12, 22, 24), it is possible to obtain a lower frequency band where AMC material structure 10 may be used. It is also possible to vary the lattice structure and distances between patches in the lattice structure. It is also possible to have some or all patches 12, 22, 24 of a layer "floating" and not connected to conducting layer 18.

It should be noted that patches 22 and 24 need not be aligned, and a single dielectric material need not be used throughout substrate 14. That is, substrate 14 may include strata of two or more types of material. In some embodiments, AMC material structure 10 of FIG. 3 may include a first dielectric material between conducting layer 18 and the bottom layer of patches 22, a second dielectric material between the bottom layer of patches 22 and the intermediate layer of patches 12, and a third dielectric material between the top layer of patches 24, and the intermediate layer of patches 12. The above-described alignment using a single material used in substrate 14 may reduce the complexity in manufacturing AMC material structure 10.

In other embodiments, patches 12, 22, 24 within the same layer of patches 12, 22, 24 may have shapes that differ, and/or patches 12, 22, 24 in different layers may have shapes that differ. In other embodiments, ones of patches 12, 22, 24 may be parasitic and disposed in one or more of the layers of patches 12, 22, 24, i.e., unconnected to conducting layer 18

The above-described principles of providing electrical connection elements 20 described relative to FIGS. 2A and 2*b* may be applied to methods and systems described herein to AMC material structure 10 shown in FIG. 3, i.e., being disposed in a layer of patches 12, 22, 24 and interconnecting patches 12, 22, 24 therein, or be provided in vias 16, 26.

Implementations of AMC material structure 10 may allow the profile of an antenna to be lowered, which is of interest with regard to portable communication devices, particularly, cellular phones, where constant efforts are being made to reduce the size of the phone together with an effort to provide increased functionality of a phone or mobile terminal.

Figure 4:
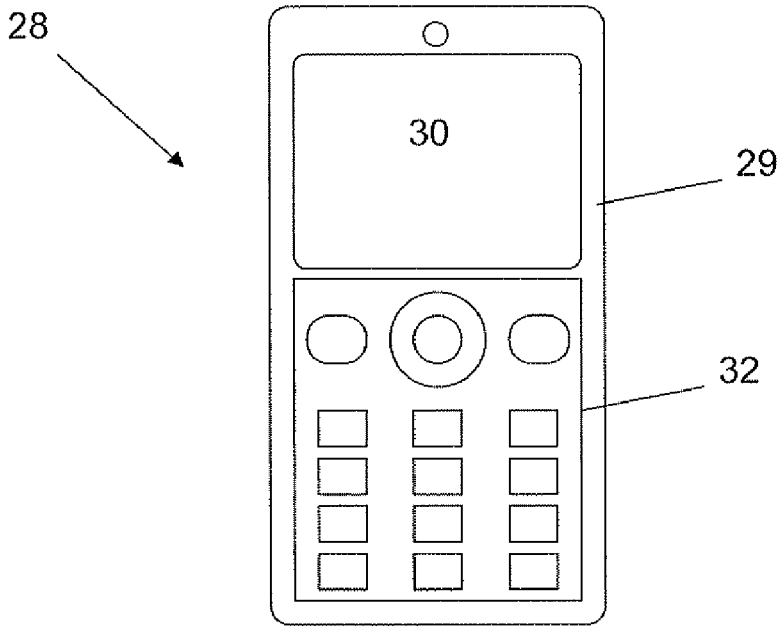
FIG. 4 shows a front view of a portable communication device in which systems and methods described herein may be implemented.

FIG. 4 shows a top view of a portable communication device 28 in the form a cellular phone. Different functional units of portable communication device 28 may be disposed inside a casing or housing 29, which, on a front side, may be provided with openings through which a display 30 and a keypad 32 may be provided. The front side of casing 29 may be bounded by a left long side, a right long side, a top short side, and a bottom short side, which sides may be provided at essentially right angles to the front side. Opposite of the front side, a back side (not shown) may be provided, which may be bounded by the left long side, the right long side, the top short side, and the bottom short side. In this manner, casing 29 may form a box-like structure, within which the different components and units of phone 28 may be disposed. An antenna arrangement according to the principles of the present invention may be implemented within casing 29 and near the back side of phone 28.

Figure 5:
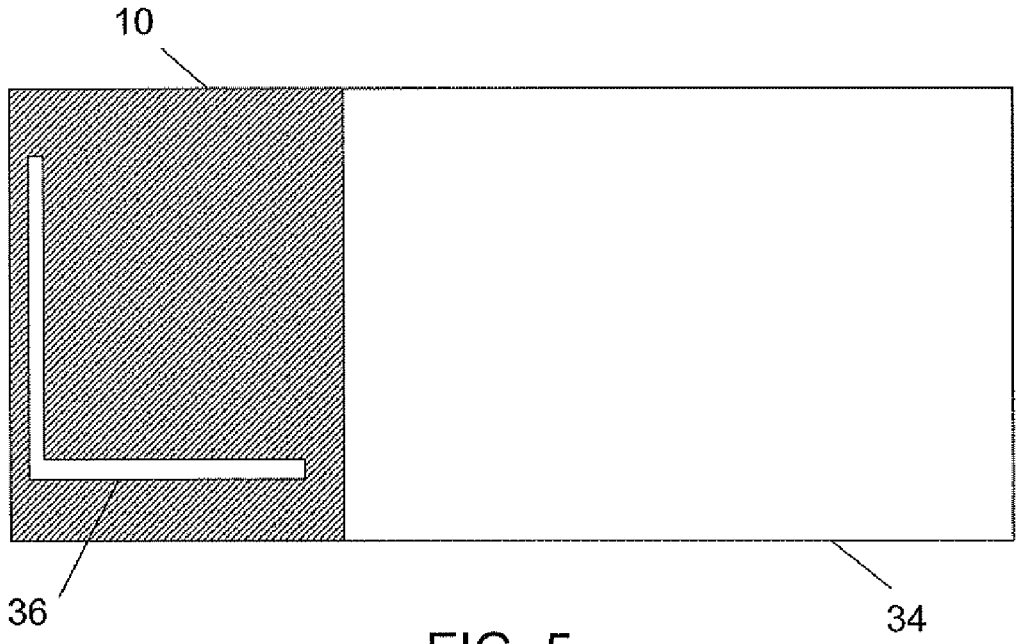
FIG. 5 schematically shows a top view of an antenna over an AMC material structure together with a circuit board.

FIG. 5 schematically shows a top view of a circuit board 34 that may include a section of AMC material structure 10 having electrical connection elements 20 arranged substantially as described above. Over AMC material structure 10, a radiating antenna element 36 may be disposed. AMC material structure 10 may face radiating antenna element 36. A small gap may be disposed between AMC material structure 10 and radiating antenna element 36. Radiating antenna element 36 and AMC material structure 10 together may form an antenna arrangement according to implementations of the present invention.

Circuit board 34 may be provided to allow for attachment to a number of components. It may also include a ground plane providing a ground potential. Conducting layer 18 of AMC material structure 10 may, according to implementations of the present invention, connect to a ground potential, which may be provided by such a ground plane. Radiating antenna element 36 may be provided in the form of pieces of sheet metal provided on a substrate. Radiating antenna element 36 may be provided through etching or other suitable placing of conductive plates and strips on a substrate, which substrate may include a dielectric material. The substrate may be provided on top of AMC material structure 10. Conducting layer 18 of AMC material structure 10 may be grounded. AMC material structure 10 may form a grounding layer of the antenna arrangement.

The use of AMC materials has other advantages, for example, allowing the antenna to be placed closer to the circuit board than other structures, thus allowing the provision of slimmer phones.

As mentioned above, electrical connection elements 20 in AMC material structure 10 may include switches. The switches may be MEMS switches, transistors, or other switch types.

Figure 6A:
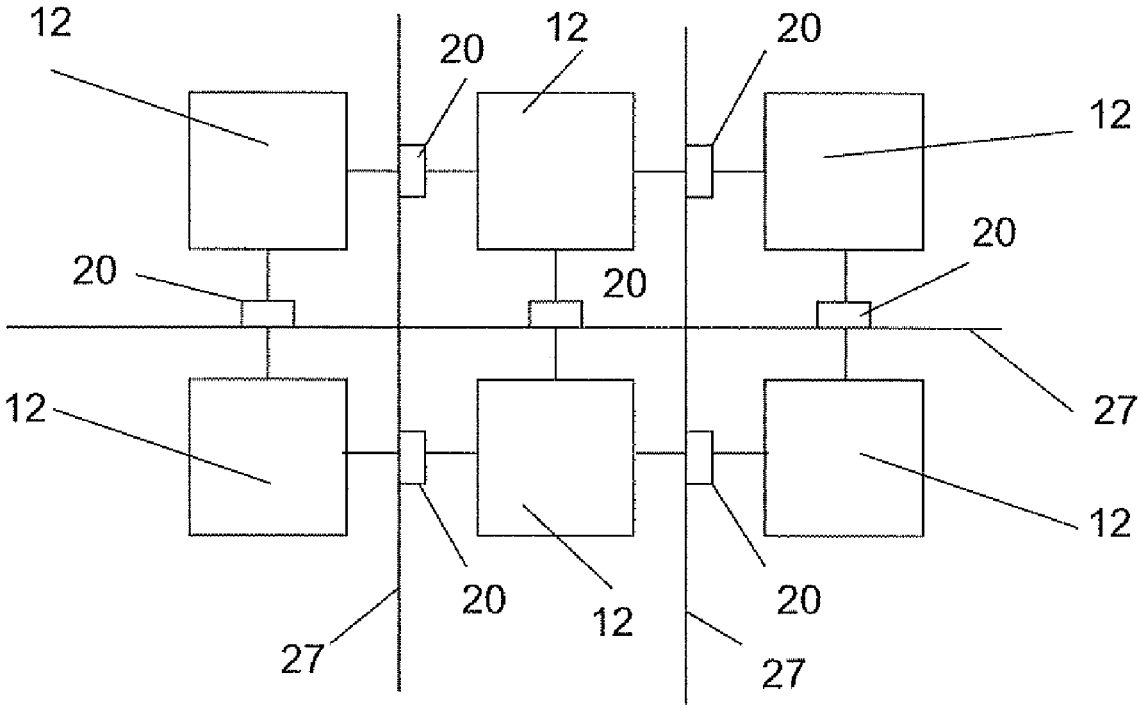
FIGS. 6A and B schematically shows various electrical configurations in which systems and methods described herein may be implemented.

FIG. 6A shows an exemplary arrangement in which electrical control lines may be provided for switches 20 that are located in the same layer as patches 12. FIG. 6A shows a plan view of a layer of patches 12 arranged in a matrix of rows and columns, for example, two rows and three columns are shown. A grid of control lines 27 may be provided in the layer in which patches 12 are provided. A first vertical line may control switches 20 between patches 12 in a first column and a second column, and a second vertical line may control switches 20 between patches in the second and a third column, while a horizontal line may control switches 20 between patches 12 in a first and a second row. So arranged, it is possible to provide for control of all or some switches 20 provided in a layer. In other embodiments, the substantially same type of structure may be provided for switches 20 located in vias 16, such that the electrical control lines are provided in a layer where the switches 20 are provided instead of the patches 12.

Figure 6B:
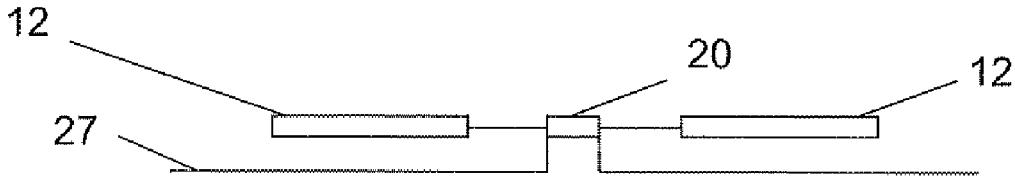

FIG. 6B shows a side view of another embodiment of a control structure for switches 20 in a layer. FIG. 6B only shows two patches 12 interconnected by switch 20. The principles shown in FIG. 6B may be applied to one or more layers of patches 12 of an AMC control structure. Here, electrical control line 27 for switch 20 may be arranged in a layer underneath the layer including patches 12 and switches 20.

Switches 20 in FIGS. 6A and 68 may be electrically controlled, i.e., controlled by electrical signals. However, it will be appreciated that they may alternatively be optically controlled, i.e. controlled by optical signals. Other control techniques may be used.

According to one embodiment of the present invention, switches 20 may be either operated to a fully open or a fully closed position, which means that in some AMC material structures 10 described, switches 20 may connect/disconnect adjacent patches 12, 22, 24 to/from each other. In some AMC material structures 10 described, switches 20 may connect/disconnect patches 12, 22, 24 to conducting layer 18, for example, patches 12, 22, 24 may either be grounded or "floating." It should be appreciated that switches 20 may be controlled independently from each other. That is, ones of switches 20 may be open, while other ones of switches 20 may be closed. With this type of switching, it is possible to change the frequency of the antenna arrangement, i.e., the combination of radiating antenna element and AMC material structure 10, to cover various frequency bands. This therefore allows the antenna arrangement to cover a wider frequency band and therefore the wideband properties of the antenna arrangement are enhanced.

In other embodiments of the present invention, switches 20 may be operated from fully closed to fully open positions and occupy partially open positions therebetween. Switches 20 can thus occupy several positions between the fully open and fully closed positions. This technique may be used, according to implementations of the present invention, in addition to providing superior broadband performance, to provide directivity of the antenna. Through suitable operation of switches 20, it is thus possible to direct the antenna arrangement in a direction of superior reception. Since an antenna arrangement performs optimally according to these measures, a lower output power can be used, which thus saves power. Since a phone is battery-powered, this is an advantage.

Electrical connection elements 20 may be active components, i.e. their performance may be externally controlled apart from the antenna arrangement. Some implementations may use electrical connection elements 20 that are passive. According to one embodiment of the present invention, electrical connection elements 20 do not accomplish switching, but rather filtering. So configured, electrical connection elements 20 may provide selective connection of a patch 12, 22, 24 with another element, for example, another patch 12, 22, 24 in the same layer, or conducting layer 18, based on frequency, for example. The filtering may be any type of filtering, for instance, band-pass filtering, low-pass, or high-pass filtering. This also allows the provision of superior broadband properties with a simpler antenna arrangement structure that does not require external control of electrical connection elements 20.

Through providing electrical connection elements 20 in the above-described techniques in AMC material structure 10, the associated band gap may be shifted and/or tuned, thereby allowing the provision of superior broadband performance, as well as allows the provision of directivity.

Systems and methods of antenna arrangements described herein may be provided for a wireless communication frequency range, such as different GSM and UMTS communication bands, television and radio transmission, such as FM and UHF bands, or Bluetooth™ or WLAN, as well as other wireless communication standards.

The present invention may be varied in many ways apart from what has been described above. It is possible to combine the above-described embodiments, for example, in that one section of AMC material structure 10 may have electrical connection elements 20 in layers of patches 12, 22, 24, while another section of AMC material structure 10 may have electrical connection elements 20 in vias 16, 26. Thus, the present invention is only to be limited by the following claims.

What is claimed is:

1. An antenna arrangement for use in a portable communication device, comprising:

a radiating antenna element; and a grounding layer comprising an artificial magnetic conductor (AMC) material structure facing the radiating antenna element, where the AMC material structure includes:

a smooth conducting layer, at least one layer of patches, and a plurality of electrical connection elements that selectively interconnect the patches to other elements of the AMC structure, where at least some of the plurality of electrical connection elements are active electrical connection elements and at least one of the plurality of electrical connection elements is not coplanar with one or more of the at least one layer of patches.

2. The antenna arrangement of claim 1, where at least some of the patches connect to the smooth conducting layer using conducting vias.

3. The antenna arrangement of claim 2, where the at least one layer of patches comprises a further layer of patches.

4. The antenna arrangement of claim 3, where the patches in the further layer of patches electrically float.

5. The antenna arrangement of claim 2, where the plurality of electrical connection elements are disposed in vias between the patches and the smooth conducting layer.

6. The antenna arrangement of claim 1, where some of the plurality of electrical connection elements are disposed in the at least one layer of patches and selectively interconnect the patches.

7. The antenna arrangement of claim 1, where the plurality of electrical connection elements comprise at least some passive elements including filters that connect the patches with the other elements based on frequency.

8. The antenna arrangement of claim 1, where the active electrical connection elements comprise switches.

9. The antenna arrangement of claim 8, where the switches are to be operated at a number of partially open positions between fully closed and fully open positions, inclusively.

10. The antenna arrangement of claim 8, where the switches are to be controlled by applied electrical signals via an electrical control line that is not coplanar with at least one of a plane in which the switches are disposed or a plane containing the at least one layer of patches.

11. The antenna arrangement of claim 8, where the switches are to be controlled by applied optical signals via an electrical control line that is not coplanar with at least one of a plane in which the switches are disposed or a plane containing the at least one layer of patches.

12. A portable communication device comprising:

a radiating antenna element; and a grounding layer including an artificial magnetic conductor (AMC) material structure facing the radiating antenna element, where the AMC material structure includes:

a smooth conducting layer, at least one layer of patches, and a plurality of electrical connection elements that selectively interconnect the patches to other elements of the AMC structure, where at least one of the plurality of electrical connection elements is an active electrical connection element and at least one other one of the plurality of electrical connection elements is not coplanar with one or more of the at least one layer of patches.

13. The portable communication device of claim 12, where at least some of the patches connect to the smooth conducting layer using conducting vias.

14. The portable communication device of claim 13, where the at least one layer of patches comprises a further layer of patches.

15. The portable communication device of claim 14, where the patches in the further layer of patches electrically float.

16. The portable communication device of claim 13, where the electrical connection elements are disposed in vias between the patches and the smooth conducting layer.

17. The portable communication device of claim 12, where some of the plurality of electrical connection elements are disposed in the at least one layer of patches and selectively interconnect the patches.

18. The portable communication device of claim 12, where the plurality of electrical connection elements comprise at least some passive elements including filters that connect the patches with the other elements based on frequency.

19. The portable communication device of claim 12, where the active electrical connection elements comprise switches.

20. The portable communication device of claim 19, where the switches are to be operated at a number of partially open positions between fully closed and fully open positions, inclusively.

21. The portable communication device of claim 19, where the switches are to be controlled by applied electrical signals via an electrical control line that is not coplanar with at least one of a plane in which the switches are disposed or the at least one layer of patches.

22. The portable communication device of claim 19, where the switches are to be controlled by applied optical signals via an electrical control line that is not coplanar with at least one of a plane in which the switches are disposed or the at least one layer of patches.

23. The portable communication device of claim 12, where the portable communication device is a cellular phone.

* * * * *